United States Patent [19]

Nara et al.

[11] 4,117,908

[45] Oct. 3, 1978

[54] ELEVATOR HAVING ROPE GUIDE MEANS

[75] Inventors: Toshihiko Nara; Norihiko Mitsui; Masayuki Shigeta, all of Katsuta, Japan

[73] Assignee: Hitachi, Ltd., Japan

[21] Appl. No.: 306,457

[22] Filed: Nov. 14, 1972

[51] Int. Cl.[2] ..... B66B 11/04

[52] U.S. Cl. ..... 187/20; 187/95

[58] Field of Search ..... 187/20, 27, 94, 95, 187/21, 22, 23; 254/190 R

[56] References Cited

U.S. PATENT DOCUMENTS

| | | | |
|---|---|---|---|
| 3,524,606 | 8/1970 | Coski | 242/158 |
| 3,559,768 | 2/1971 | Cox | 187/94 |
| 3,662,862 | 5/1972 | Poller | 187/95 |
| 3,666,051 | 5/1972 | Davis et al. | 187/20 |

*Primary Examiner*—Allen N. Knowles

*Attorney, Agent, or Firm*—Craig & Antonelli

[57] ABSTRACT

An elevator including a rope vibration suppressing device provided on the floor of a machinery room, on the top of a elevator cage or on the top portion of balancing weight means to prevent lateral vibration of ropes which may otherwise be produced when a building in which the elevator is equipped is laterally swung.

11 Claims, 16 Drawing Figures

ELEVATOR HAVING ROPE GUIDE MEANS

The present invention relates to an elevator particularly to a high speed elevator of a type including a cage connected to one end of rope means, a balancing weight connected to the other end of the rope means and a winch for winding and unwinding the rope means to make the cage pulled upwardly and downwardly.

Recent remarkable progress of construction technique caused a remarkable increase of extremely high storied buildings. In such high storied buildings, in order to provide efficient transportation means, high speed elevators must be provided. Since a usual high storied building is of a relatively resilient construction, a lateral vibration is easily produced when it is subjected to an earthquake shock or a strong wind. Thus, a corresponding lateral vibration is also produced in the rope means of an elevator equipped therein, and the vibration of the rope means is transmitted to a cage connected thereto giving an unpleasant feeling to a person in the cage. Further, if the vibration amplitude of the rope means is of substantially large, the rope means may abut the edge of an opening which is provided in the floor of a machinery room for passing the ropes therethrough. Under this circumstance, the ropes may possibly be damaged by the edge of the opening. Moreover, a large amplitude of vibration of rope means may cause an interference between the ropes and guide groove means formed in the winch and, in an extreme case, a disengagement of the ropes from the guide groove means. Further, when there is any distortion or misalignment in guide rails provided in the building for forming a path of the elevator cage, the movement of the cage is disturbed and an unpleasant feeling is given to the person in the cage.

Japanese Pat. No. 247374 and the U.S. Pat. No. 3,666,051 propose means for preventing such a lateral vibration of rope means in an elevator system. In each of these known arrangements, rope vibration suppressing means is provided at an intermediate portion of a path for a cage, so that the cage abuts and then carries the suppressing means during its upward movement. The arrangement is found as being satisfactory for the purpose when it is applied to an elevator system of relatively low speed, however, in an elevator system in which a cage is moved at a speed exceeding 200 m/min., intermittent abutting engagement of the cage with the suppressing means produces a relatively high shock and noise. Thus, the known arrangement is not practically usable in a high speed elevator system.

Therefore, the present invention has an object to provide means for preventing a lateral vibration of an elevator cage and rope means caused by lateral quake of building.

According to the present invention, the above object can be achieved by an elevator system comprising a winch provided in a machinery room, rope means adapted to be wound on and unwound from said winch, a cage and a balance weight suspended by said rope means and adapted to be moved upward and downward by said winch through said rope means, and rope vibration supressing means provided on at least one of the floor of the machinery room, the top portion of the cage and the top portion of the balance weight so as to prevent lateral vibration of said rope means.

Another object of the present invention is to provide rope vibration supressing means for an elevator system, which is simple in construction and ready for maintenance.

A further object of the present invention is to provide means for preventing lateral vibration of an elevator cage due to an vibration of rope means, or a distortion or misalignment of guide rail means providing a path for the cage.

Still further object of the present invention is to provide rope vibration suppressing means which can be provided in position without necessitating a large top clearance between the floor of the machinery room and the top portion of an elevator cage.

A further object of the present invention is to reduce wear of the rope vibration suppressing means and that of the rope means due to a rubbing engagement therebetween.

The above and other objects and features of the present invention will become apparent from the following descriptions of preferred embodiments taking reference to the accompanying drawings in which.

Figure 1:
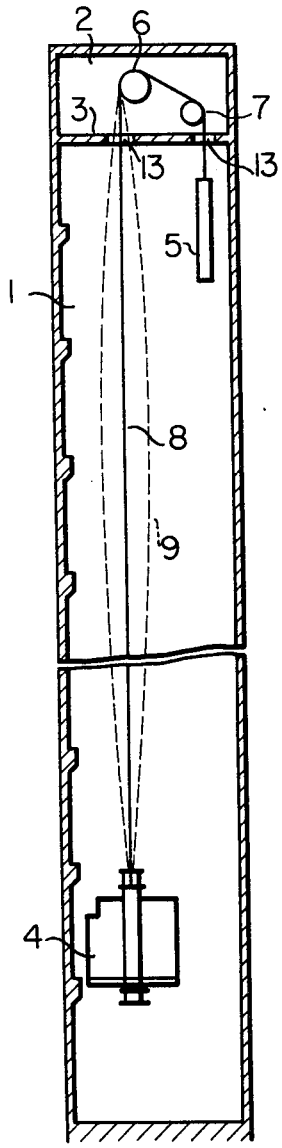
FIG. 1 is a vertical sectional view of an elevator system to which the present invention can be applied, the section being taken along the path for an elevator cage.
Figure 2:
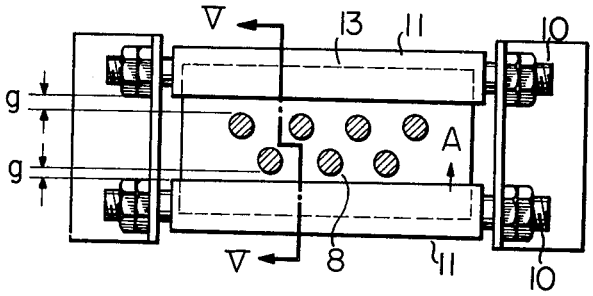
FIG. 2 is a plan view of an embodiment of the rope vibration suppressing means in accordance with the present invention.
Figure 3:
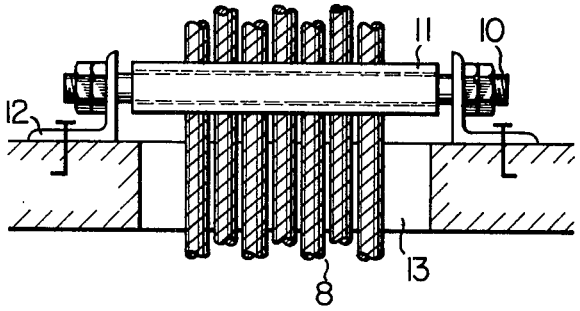
FIG. 3 is a front view of rope vibration suppressing means provided on the upper surface of the floor of the machinery room.
Figure 5:
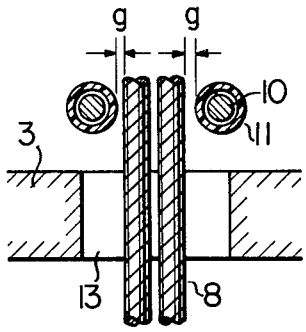
FIG. 5 is a sectional view taken along the line V—V in FIG. 2.

Referring first to FIG. 1, there is shown an elevator cage 4 which is suspended by generally a plurality of ropes 8. The ropes 8 are passed from the cage 4, through an opening 13 provided in the floor 3 of a machinery room 2, a winch 6 provided in the machinery room 2, a guide wheel 7 and another opening 13 in the floor 3. At the terminal ends of the ropes 8, there is suspended a balancing weight 5. Thus, the cage 4 and the balancing weight 5 are vertically moved by the operation of the winch 6 along guide rail means (not shown) provided in cage path 1.

When the building in which the elevator system is equipped is subjected to an earthquake or hard wind, a lateral vibration may be produced in the ropes 8 as shown in dotted lines in FIG. 1. The vibration of the ropes 8 may possibly be transferred to the cage 4 and the balancing weight 5. According to one mode of the present invention, means is provided near the floor of the machinery room for suppressing the rope vibration.

Figure 4:
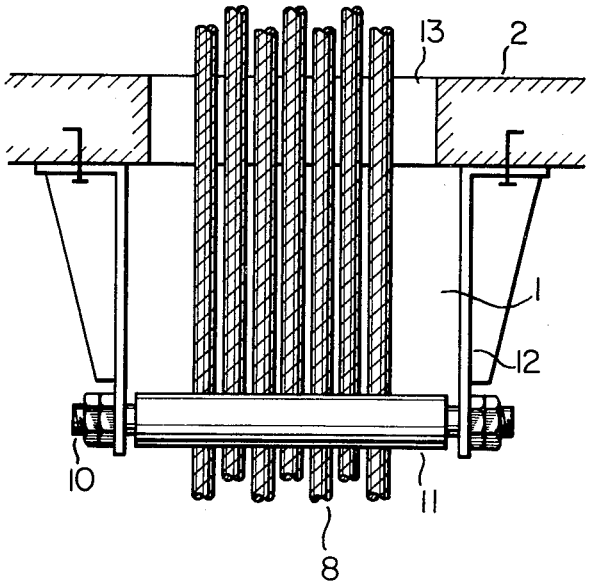
FIG. 4 is a front view of rope vibration suppressing means provided on the lower surface of the floor of the machinery room.

FIGS. 2 through 5 show examples of rope vibration suppressing means in accordance with the present invention. From FIG. 2, it will be clear that the illustrated arrangement of the ropes 8 is effective to restrict the vibration of the ropes 8 in the lateral direction in FIG. 2 because of the mutual interference of the ropes, but the ropes 8 are free to vibrate in the direction perpendicular to the arrow A. In this view, a pair of stopper rollers 11 are provided at the opposite sides of the ropes 8. Each of the rollers 11 is rotatably supported on a shaft 10 which is secured at its opposite ends to brackets 12 mounted on the upper surface of the floor 3 of the machinery room 2. In the arrangement of FIG. 4, the rollers 11 are positioned beneath the floor 3 by means of shafts 10 and brackets 12. The rollers 11 are positioned with a spacing (*g*) to the adjacent ropes 8 so that the ropes do not contact with the rollers 11 under a normal condition. It is preferable that the rollers 11 are made of a plastic material such as nylon so as to reduce noise which may be produced when the ropes 8 abuts the rollers 8. In order to reduce possible wear of the rollers 11, they are rotatably suppported on the shafts 10, however, they may be integral with the shaft 10 which may then be rotatably supported on the brackets 12. In the arrangement where the rope vibration suppressing means is provided beneath the floor 3 as shown in FIG. 4, the means should preferably be located as close as possible to the cage 4 at the uppermost stair in order to effectively suppress the vibration of the cage 4.

The aforementioned arrangements are effective to suppress the vibration of the ropes 8 due to the vibration of the building without sacrificing the function of the elevator. Further, the arrangements are also effective to prevent the ropes 8 and the openings 13 in the floor 3 from being damaged due to a rubbing engagement therebetween. Since the vibration of the cage 4 and that of the balancing weight 5 can be suppressed, a comfortable feeling can be given to a person in the cage. It is also possible in accordance with the above described arrangements to reduce wear of the ropes and the rollers and, even when the rollers are worn, they can be readily replaced by new ones. Thus, the arrangements provide ready and less expensive maintenance.

A further embodiment of the present invention will now be described taking reference to FIGS. 6 through 9.

Figure 6:
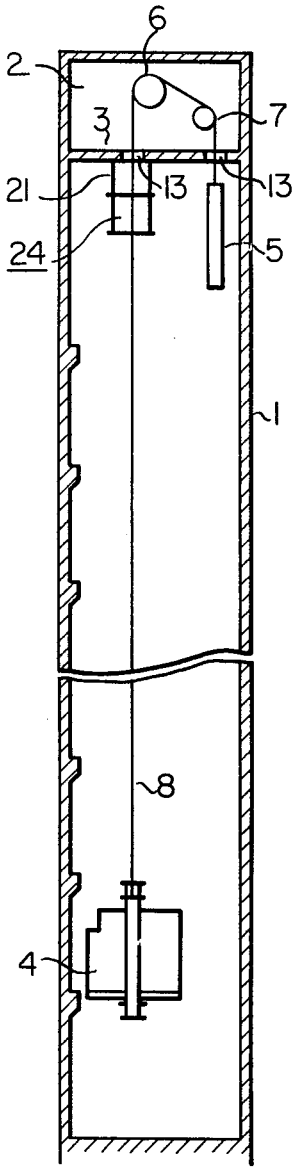
FIG. 6 is a vertical sectional view of an elevator cage path in accordance with another embodiment of the present invention.
Figure 7:
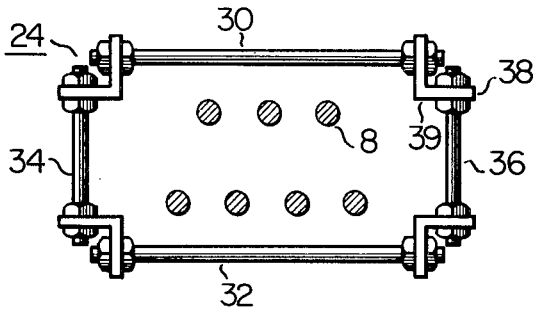
FIGS. 7 and 8 show in plan views different forms of rope vibration suppressing means of the present invention.
Figure 8:
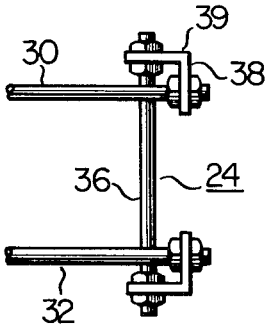
Figure 9:
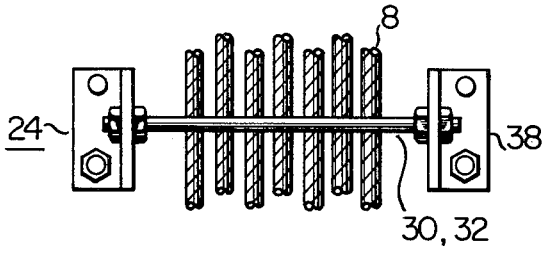
FIGS. 9 is a front view of the suppressing means shown in FIG. 7.

Referring to FIG. 6, rope vibration suppressing means 24 is shown as being swingably suspended from the floor 3 of the machinery room 2 by means of chains or suspending ropes 21. The details of the suppressing means 24 are shown in FIGS. 7 through 9. The means 24 comprises a rectangular frame constituted by rod members 30, 32, 34 and 36 which are so arranged as to encircle the ropes 8 and connected together by angle shaped fittings 38. The means 24 is suspended beneath the floor 3 by the suspending ropes 21. The rod members 30, 32, 34 and 36 are preferably made of wear resistant plastic material such as nylon so as to reduce noise which may be produced when the ropes 8 abut the rod members. The rod members may be constituted by rollers as in the previous embodiment. FIG. 7 shows another arrangement in which the fittings 38 are arranged with their corners 39 directed outwardly. This arrangement is advantageous in that there is no risk that the ropes 8 come into rubbing contact with the corners 39 of the fittings 38 to be damaged thereby. In these arrangements, the rope vibration suppressing means 24 is suspended beneath the floor 3 by the suspending rope 21 so that, when a lateral vibration is produced in the building, each of the ropes 8 randomly abuts the rope vibration suppressing means 24 whereby the lateral vibration of the ropes 8 is suppressed. Thus, there is no risk that the ropes 8 come into rubbing contact with the edge of the opening 13. Further, the oscillation of the cage 4 can be effectively prevented and a comfortable feeling is given to a person in the cage 4. In the arrangement of FIG. 8, when the rod members 30, 32, 34 and 36 are substituted by rollers rotatably supported on shafts, it is possible to reduce wear of the ropes and the rope vibration suppressing means and the noise which may be produced when the ropes abut the suppressing means. The rope vibration suppressing means 24 is preferably located as close as possible to the cage 4 at the topmost stair. Alternatively, a plurality of suppressing means may be provided.

Figure 10:
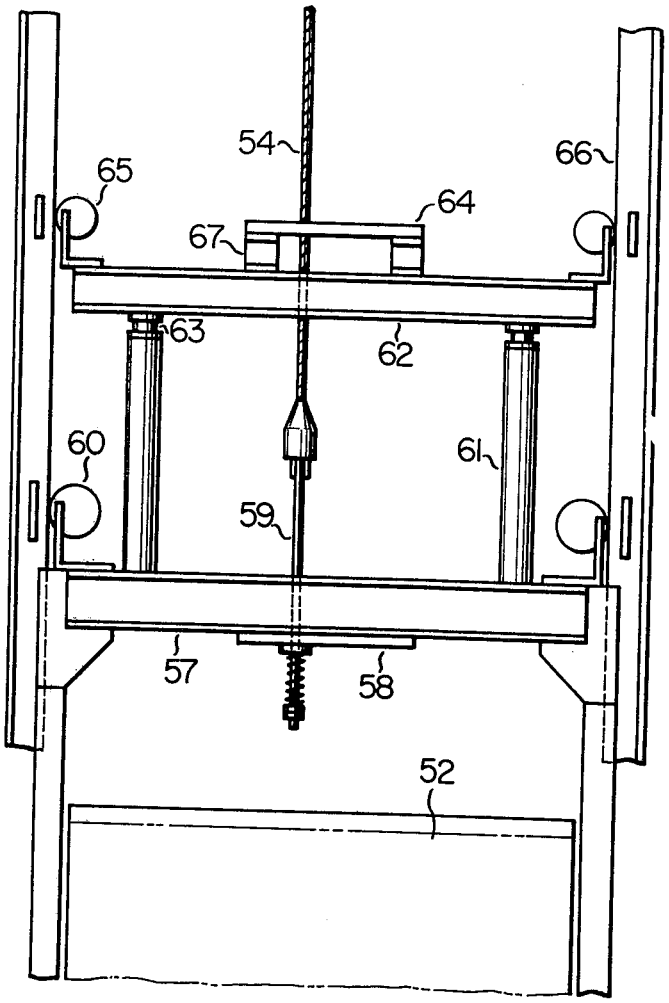
FIG. 10 is a front view of an elevator cage in accordance with another embodiment of the present invention in which rope vibration suppressing means is provided on the cage.

A further embodiment will now be described taking reference to FIGS. 10 through 12. Referring to FIG. 10, there is shown in front view the upper portion of an elevator cage. The reference numeral 54 designates ropes, 57 a cross head, 58 a suspending plate, 59 a thimble rod connecting the ropes 54 with the cage 52, and 60 guide means for guiding the cage 52 along guide rails 66. The guide means 60 usually comprises three rubber rollers and biasing springs therefor. The biasing springs are of relatively small spring constant so that they absorb any disturbance of the cage movement due to a distortion or misalignment of the guide rails 66. When the building is subjected to an earthquake or a hard wind to be vibrated laterally, the ropes 54 are correspondingly vibrated to cause a lateral movement of the cross head 57. Since the spring constant of the biasing springs are relatively small, the lateral vibration of the cross head may possibly be transferred to the cage 52. This embodiment makes it possible to restrict any lateral vibration of the cage and that of the balancing weight at the upper portion of the cage and the upper portion of the balancing weight. For this purpose, base frames 61 are provided on the cross head 57 and a resilient member 63 is interposed between each of the base frames 61 and an upper beam 62 so that any oscillation of the upper beam 62 and other parts thereon is not transmitted to the cage 52. The ropes 54 are attached to a plate 64 which is mounted on the upper beam 62 through spacers 67. The plate 64 is located at such a position that the connection between the ropes 54 and the plate 64 is in the same plane as the positions where the guide means 65 contact the guide rails 66.

Figure 11:
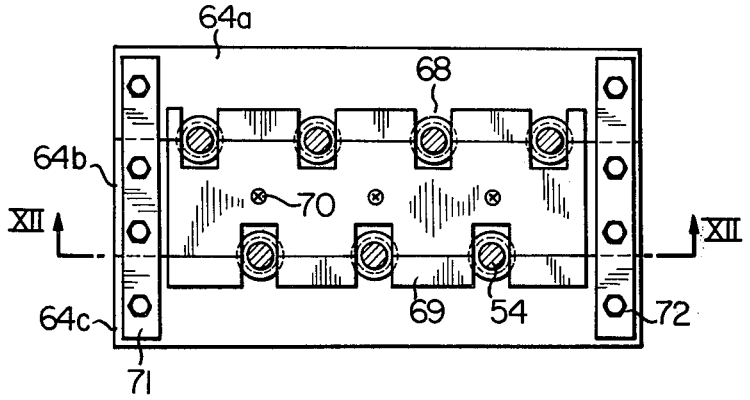
FIG. 11 is a plan view of a rope fixing device.
Figure 12:
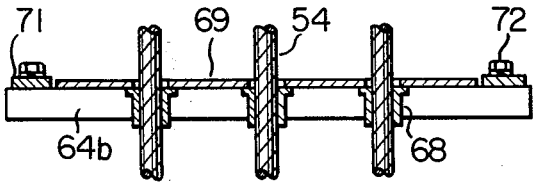
FIG. 12 is a sectional view taken along the line XII—XII in FIG. 11.

FIG. 11 shows in plan view the details of the connection between the ropes 54 and the plate 64, and FIG. 12 is a sectional view taken along the line XII—XII in FIG. 11. As shown in FIG. 11, the plate 64 comprises three pieces 64*a*, 64*b* and 64*c*, and each of the ropes 54 has a bush 68 secured thereto. The bushes 68 are so arranged that they are positioned between two of the plate pieces 64*a* and 64*b* or 64*b* and 64*c* and hald against disengagement by means of a holding plate 69. The plate pieces 64*a*, 64*b* and 64*c* are secured together by connecting plates 21 and bolts 72. The holding plate 69 is secured to the plate piece 64*b* by a plurality of screws 20. Thus, the ropes 54 are secured to the plate 64. It should of course be noted that a similar arrangement may be provided on the upper portion of the balancing weight.

According to this embodiment, a rope vibration suppressing means is thus provided above the elevator cage and/or the balancing weight in such a manner that the means holds the intermediate portions of the ropes independently from the cage or the balancing weight, so that any vibration of the ropes can be absorbed by said suppressing means. Further, any disturbance of the movement of the cage due to a possible distortion or misalignment of the guide rails can be absorbed by the guide means 60. Thus, the arrangement can provide an elevator system which does not give any discomfortable feeling to person in the elevator cage.

In the above arrangement, the base frames are connected with the upper beam through resilient members, however, it is of course possible to make the base frames themselves from a resilient material.

In the above embodiment, the rope vibration suppressing means is provided above the cross head 57. In this arrangement, it is necessary to maintain an increased distance between the floor of the machinery room and the cage when the latter is stopped at the topmost stair in order to keep a clearance as required by regulation. Further, the arrangement additionally requires guiding means 65.

Figure 13:
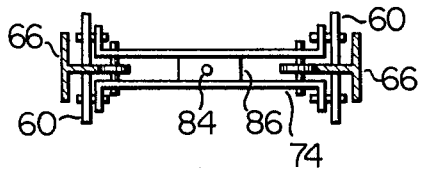
FIG. 13 is a plan view of a rope vibration suppressing means in accordance with another embodiment of the present invention.
Figure 14:
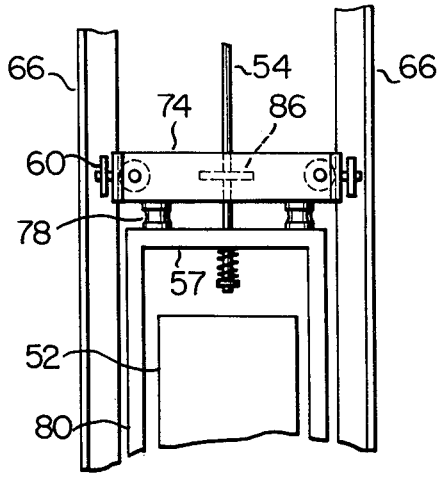
FIG. 14 is a front view of the upper portion of an elevator cage which has the rope vibration suppressing means shown in FIG. 13.

The embodiment shown in FIGS. 13 through 16 can eliminate the aforementioned disadvantages of the previous embodiment. Referring to FIGS. 13 and 14, a plurality of resilient members 78 are provided for supporting an vibration suppressing frame 74 above a cross head 57. At the opposite ends of the frame 74, there are provided guide means 60 such as rubber rollers for guiding an elevator cage 52 along guide rails 66. A plate 86 is secured to the frame 74 at an intermediate portion thereof and formed with an aperture 84 for fitting a rope 54 to the plate 86. The plate 86 should preferably be secured to the frame 74 at such a height that its vertical center point is aligned with the vertical center of the frame 74.

In this arrangement, the guide means 60 and the resilient members 78 are effective to absorb lateral vibration of the frame 74, and the frame 74 and the resilient member 78 further serve to absorb lateral vibration of the rope 54. Therefore, any of such vibration is not transferred to the cross head 57 which is secured to a support frame 80 for the cage 52. In this arrangement, it is sufficient to provide only one guide means at each side of the upper portion of the cage 52, so that the vibration suppressing frame 74 can be equipped within the height of conventional guide means.

Figure 15:
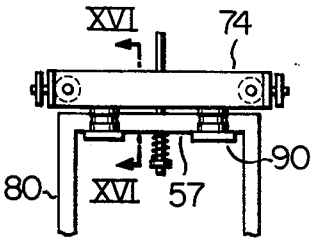
FIG. 15 is a front view of an arrangement in which a rope vibration suppressing means is located close to an elevator cage; and, FIG. 16 is a sectional view taken along the line XVI—XVI in FIG. 15.
Figure 16:
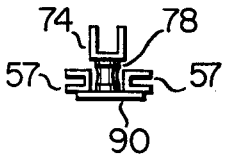

In the arrangement of FIGS. 15 and 16, the suppressing frame 74 is located close to the cross head 57. As shown in FIG. 16, the cross head 57 is usually constituted by two channel section members which are disposed in spaced parallel relationship. In the space between the channel section members, there are disposed resilient members 78 which are supported by support plates 90. Thus, it is possible to locate the frame 74 close to the cross head 57, so that it is not necessary to increase the height of the building. This arrangement may be employed in combination with a rope oscillation suppressing means provided on the floor of the machinery room. In this arrangement, any lateral vibration caused by a distortion or misalignment of the guide rails 66 can be absorbed by the guide means 60 and the resilient members 78, and any vibration of the rope 54 can be absorbed by the vibration suppressing frame 74 and the resilient members 78. Thus, there is no possibility that the vibration is transmitted through the cross head 57 to the cage 52. Further, since the frame 74 can be positioned very close to the cross head 57, it is not necessary to increase the height of the building.

The invention has thus been shown and described with reference to preferred embodiments, but it should be noted that the invention is in no way limited to the details of the illustrated arrangements and that many changes and modifications can be made thereto without departing from the scope of the appended claims.

We claim:

1. An elevator system comprising a winch provided on the floor of a machinery room, rope means adapted to be wound on said winch, an elevator cage and a balancing weight suspended by said rope means and adapted to be moved vertically by means of said winch through said rope means, and a rope vibration suppressing means fixedly secured at the floor of the machinery room for suppressing lateral vibration of said rope means independently of the positioning of said elevator cage along the path of movement thereof, said rope vibration suppressing means including two members disposed opposite one another, each of said members being arranged with a clearance with respect to said rope means and arranged to contact said rope means only when said rope means vibrates laterally so as to suppress the vibration thereof.

2. An elevator system in accordance with claim 1 in which said rope vibration suppressing means is swingably suspended from the floor of said machinery room by means of suspending means such as chains or ropes having one end thereof secured at the floor of said machinery room.

3. An elevator system in accordance with claim 2 in which said rope vibration suppressing means comprises a frame constituted by rod members encircling said rope means and connected by fitting means located outside a closed space defined by said rod members.

4. An elevator system in accordance with claim 1 in which said rope vibration suppressing means comprises roller means supported rotatably about a horizontal axis on stationary bracket means secured at the floor of the machinery room.

5. An elevator system in accordance with claim 4 in which said roller means comprises at least one hollow roller rotatably supported by means of a shaft inserted into said roller.

6. An elevator system in accordance with claim 4 in which said roller means is arranged with a clearance (*g*) with respect to said rope means.

7. An elevator system in accordance with claim 4 in which said rope vibration suppressing means is mounted on a lower surface of the floor of the machinery room and extends downwardly therefrom.

8. An elevator system in accordance with claim 1, comprising a further rope vibration suppressing means resiliently carried by one of the cage and the balancing weight, said further rope vibration suppressing means including at least one guide means for engaging guide rail means provided along the path of said elevator cage.

9. An elevator system in accordance with claim 8 in which said rope vibration suppressing means is mounted on an upper surface of the floor of the machinery room and extends upwardly therefrom.

10. An elevator system comprising a winch provided on the floor of a machinery room, rope means adapted to be wound on said winch, an elevator cage and a balancing weight suspended by said rope means and adapted to be moved vertically by said winch through said rope means, frame means including said cage and having a cross head at the upper portion thereof for engaging with said rope means, guide means provided above the cross head at the opposite ends thereof for moving along guide rail means, vibration suppressing frame having aperture means for engagement with said rope means to suppress lateral vibration of said rope means, and resilient means provided between said vibration suppressing frame and said cross head to support the former.

11. An elevator system in accordance with claim 10, in which said cross head is formed of a space in which said resilient means is disposed, said cross head being further provided with support plate means for supporting said resilient means, whereby said vibration suppressing frame is located close to said frame means.

* * * * *